US007977824B2

(12) United States Patent
Halen et al.

(10) Patent No.: US 7,977,824 B2
(45) Date of Patent: Jul. 12, 2011

(54) SWITCHING DEVICE, USE THEREOF AND A METHOD FOR SWITCHING

(75) Inventors: Stefan Halen, Västerås (SE); Ola Jeppsson, Västerås (SE); Edgar Dullni, Ratingen (DE); Hans Begge, Wuppertal (DE)

(73) Assignee: ABB Research Ltd. (CH)

( * ) Notice: Subject to any disclaimer, the term of this patent is extended or adjusted under 35 U.S.C. 154(b) by 0 days.

(21) Appl. No.: 12/533,659

(22) Filed: Jul. 31, 2009

(65) Prior Publication Data

US 2009/0315654 A1 Dec. 24, 2009

Related U.S. Application Data

(63) Continuation of application No. PCT/EP2008/050921, filed on Jan. 28, 2008.

(30) Foreign Application Priority Data

Feb. 2, 2007 (EP) ..... 07101620

(51) Int. Cl.
*H01H 47/00* (2006.01)

(52) U.S. Cl. ..... 307/130

(58) Field of Classification Search ..... 307/112, 307/130

See application file for complete search history.

(56) References Cited

U.S. PATENT DOCUMENTS

| | | | | |
|---|---|---|---|---|
| 3,223,888 | A | 12/1965 | Koppelmann | |
| 4,209,814 | A | 6/1980 | Garzon | |
| 6,114,778 | A * | 9/2000 | Rostron et al. | 307/116 |

FOREIGN PATENT DOCUMENTS

| | | | |
|---|---|---|---|
| WO | 0137299 | A1 | 5/2001 |
| WO | 0195354 | A1 | 12/2001 |
| WO | 0195356 | A1 | 12/2001 |
| WO | 0223207 | A1 | 3/2002 |

OTHER PUBLICATIONS

European Search Report; EP 07 10 1620; Jun. 22, 2007; 3 pages.
International Search Report & Written Opinion of the International Searching Authority; PCT/EP2008/050921; Aug. 22, 2008; 3 pages.

* cited by examiner

*Primary Examiner* — Michael Rutland Wallis
(74) *Attorney, Agent, or Firm* — St. Onge Steward Johnston & Reens LLC

(57) ABSTRACT

A device for switching in and out a load with respect to an alternating voltage feeder has two mechanical switches connected in series in a current path between the load and the feeder and each having a by-pass branch with at least one member with ability to block current therethrough in at least a blocking direction and conduct current therethrough in at least one direction. A unit is adapted to control a procedure of a switching out and switching in by synchronization with the current in the feeder and the voltage of the feeder, respectively.

30 Claims, 10 Drawing Sheets

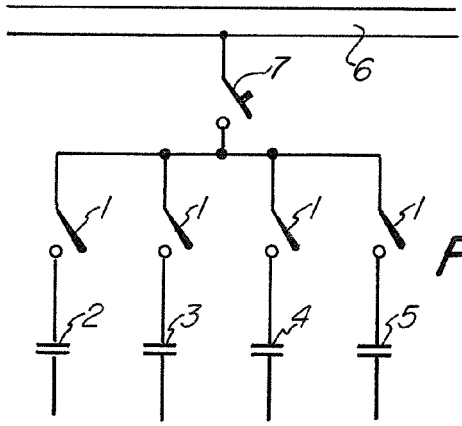
FIG. 1
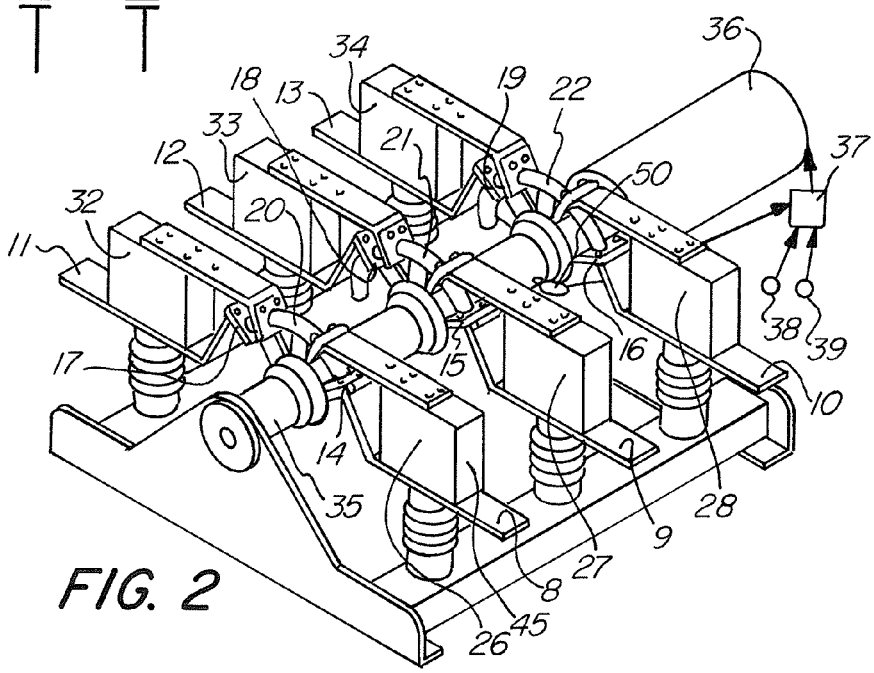
FIG. 2
FIG. 3
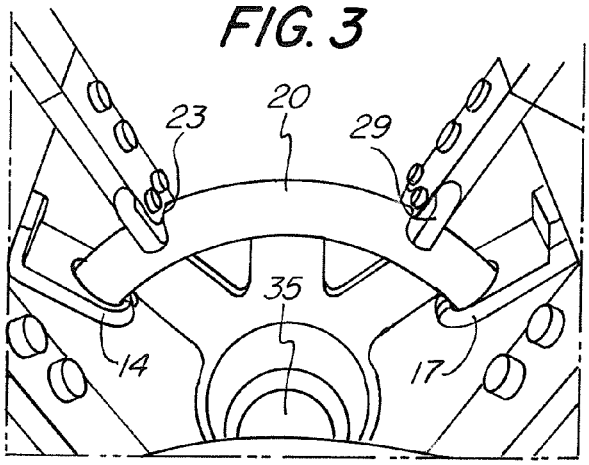
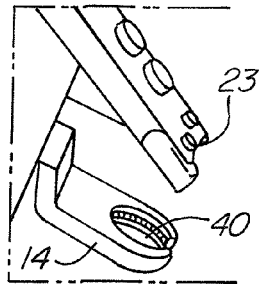
FIG. 4

FIG. 6
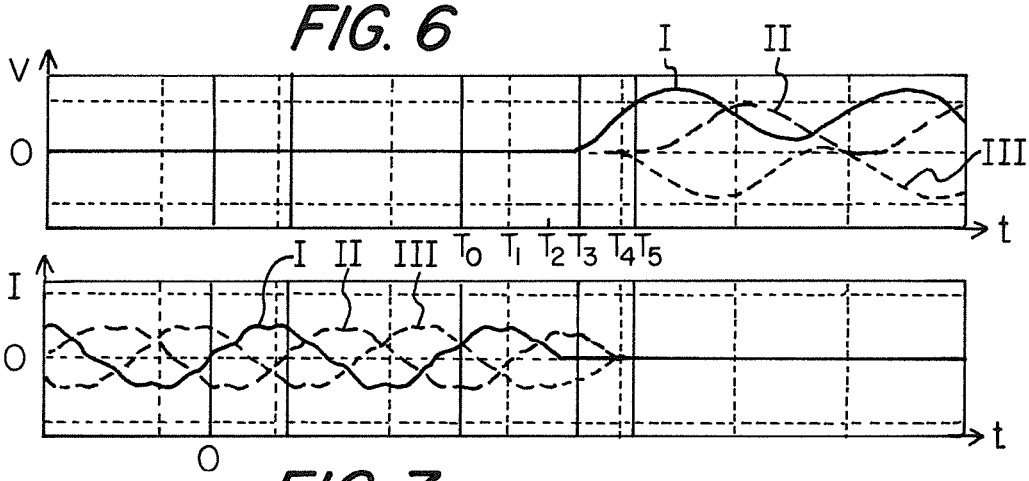
FIG. 7
FIG. 9
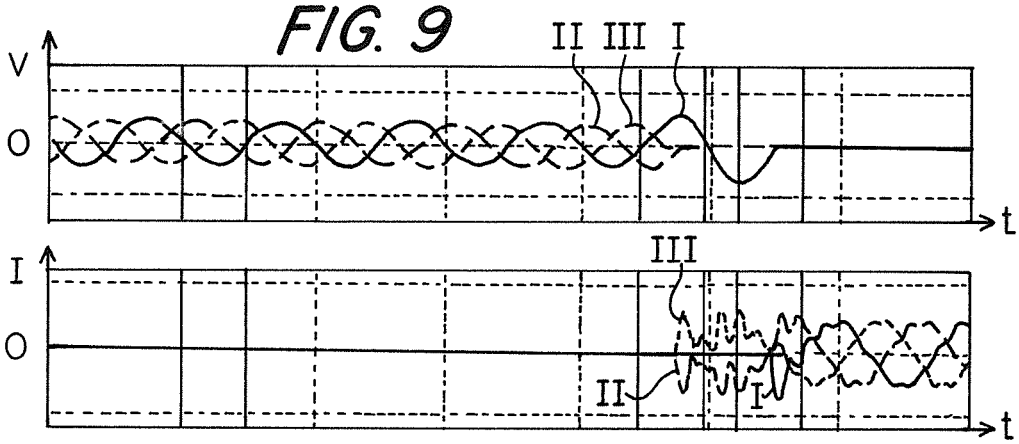
FIG. 10
FIG. 12
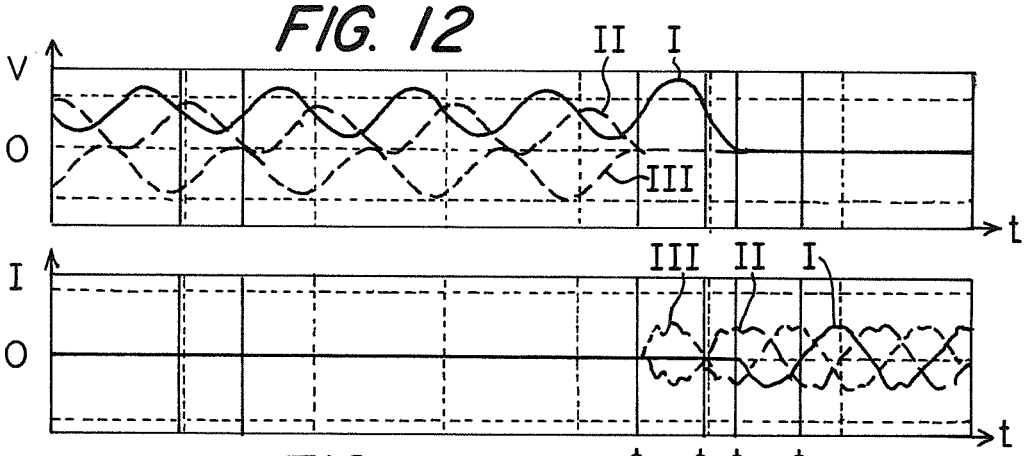
FIG. 13

SWITCHING DEVICE, USE THEREOF AND A METHOD FOR SWITCHING

CROSS-REFERENCE TO RELATED APPLICATIONS

The present application is a continuation of pending International patent application PCT/EP2008/050921 filed on Jan. 28, 2008 which designates the United States and claims priority from European patent application 07101620.8 filed on Feb. 2, 2007, the content of which is incorporated herein by reference.

FIELD OF THE INVENTION

The present invention relates to a device for switching in and out a load with respect to an alternating voltage feeder, said device having at least one mechanical switch in a current path adapted to connect the feeder and the load, as well as a unit adapted to control said switch to close and open for performing said switching in and out, respectively, as well as a method for switching according to the preamble of the appended independent method claim.

BACKGROUND OF THE INVENTION

Such devices may be used for switching in and out any type of load with respect to an alternating voltage feeder, especially a three-phase alternating voltage feeder, such as an electricity network for distribution or transmission of electric power. However, the invention is directed to such feeders having at least one phase and not only three-phases, although that may be the most common use thereof. Thus, the load may for instance be a capacitor bank used for reactive power compensation and switched in dependence of conditions prevailing at such a network, such as the consumption of for instance an industry connected thereto for reducing losses. The use of a switching device of this type for switching in and out a load comprising one or more capacitors will hereinafter be discussed for illuminating the invention but not in any way restrict the invention to that application.

It is known to use so called vacuum contactors for switching in and out capacitors with respect to a three-phase alternating voltage feeder for reactive power compensation. However, switching with such vacuum contactors is neither synchronized with the current nor the voltage in said feeder or network, which may result in inrush currents at closing the current path between said two main contacts (switching in) and re-strikes at opening (switching out). Thus, it is necessary to install reactors in series with the capacitor or capacitor bank to limit the current transients, which may be harmful to equipment connected to the network.

SUMMARY OF THE INVENTION

The object of the present invention is to provide a device of the type defined in the introduction, which reduces at least one of the inconveniences mentioned above of such switching devices already known.

This object is according to the invention obtained by providing such a device, which comprises two first said mechanical switches connected in series in said current path and each having a by-pass branch with at least one member with ability to block current therethrough in at least a blocking direction and conduct current therethrough in at least one direction, and that said unit is adapted to control a procedure of a switching out in synchronization with the current in said current path by opening one of said first switches when said at least one member in parallel therewith is in the conducting state for transferring the current therethrough and opening another mechanical switch of the device in series with said at least one member last mentioned when this member is in the blocking state and to control a procedure of a switching in in synchronization with the voltage in said feeder by, when a said at least one member in parallel with one of said first switches is in the blocking state, closing another mechanical switch of the device and closing said first switch last mentioned when said at least one member in parallel therewith is in the conducting state.

By arranging said two mechanical switches with said by-pass branches and designing the unit to control the procedure of switching out and switching in in said synchronized way a number of advantages are obtained. No inrush reactors are needed, since the contact making is made by said members and they start to conduct when the voltage difference between the feeder side and the load side changes sign. No re-strikes will occur at opening (switching out). A high number of operations is possible during the lifetime of such a switching device.

Furthermore, said members are during a switching in or out only active for less than a half period of said alternating voltage at each operation, so that they may be under-dimensioned for current. This in combination with the fact that the switching device is only designed for switching load currents, and accordingly no short circuit currents, which may be handled by a separate breaker, means that the costs for said members may be kept at an attractive low level. These members may according to an embodiment of the invention be diodes, and said at least one member may be one or a plurality of diodes connected in series and/or in parallel.

The key to all these advantages is the synchronization of the control of said switches with the current in the feeder when switching out (opening) and the voltage of the feeder when switching in (closing).

Devices of similar design are known through WO 01/95354 A1 and WO 01/95356 A1, but the devices described in those publications are switching devices used as breakers upon occurrence of a fault, so that the diodes thereof have to be able to take short circuit currents. These known devices also have to react very fast upon occurrence of a fault and to be able to interrupt currents in both directions, which is obtained by using one or the other diode depending of the current direction. This is contrary to the present invention, which is directed to a device for switching out as well as switching in a load with respect to a feeder and in which interruption may be made by only one said member and making by the other said member when desirable, which is possible since the device is only intended to operate a known load and it is not time critical.

According to an embodiment of the invention the device comprises, besides two said first switches, at least one further, second mechanical switch connected in series with said at least one member of both said by-pass branches. The arrangement of such a second mechanical switch in series with said at least one member of both said by-pass branches ensures that a physical separation may be obtained between the feeder and the load when the load is switched out with respect to the feeder, so that said members, such as diodes, may be dimensioned with a lower blocking capacity and by that to a lower cost.

According to a further embodiment of the invention the device has one said second switch, and this second switch is connected in series with both said first switches, which makes it possible to easily and reliably obtain the switching in and switching out procedure in synchronization with the current and the voltage in said current path by controlling said first switches and the second switch appropriately.

According to an embodiment of the invention said second switch connected in series with both said first switches is arranged as a middle switch between an in series with said first switches and with each at least one member, and according to another embodiment of the invention said second switch is arranged at one end of the series connection thereof and said first switches. Especially the alternative to arrange said second switch as a middle switch enables an appropriate control of the switches in a simple way, especially because of the symmetry of the device obtained in that way.

According to another embodiment of the invention the device comprises two said second switches, and one said second switch is arranged in series with said at least one member in each of said by-pass branches. This means that each said second switch may be arranged close to the respective said at least one member, which may facilitate the control of the device for a switching in and/or switching out procedure.

According to another embodiment of the invention said other switch is the other first switch, and the device has only two mechanical switches. This embodiment puts higher demands on said members in the switched out state of the device, but a device of such a simple construction may in certain applications be advantageous.

According to another embodiment of the invention, which constitutes a further development of the embodiment having one second switch arranged as a said middle switch, said unit is adapted to control a procedure of a said switching out by starting from a state in which the first switches and the second switches are closed to control one of said first switches to open when said at least one member associated therewith is in a conducting state for transfer of the current therethrough and said second switch to open when said at least one member last mentioned is in the blocking state and to control a procedure of a switching in by controlling one of said first switches to close, then said second switch to close when said at least one member associated with the other first switch is in the blocking state and finally said other first switch to close when said at least one member in parallel therewith is in the conducting state. This means that transients and inrush currents may be efficiently reduced to nearly zero when carrying out said switching in and switching out procedures.

According to another embodiment of the invention, which constitutes a further development of the embodiment having one said second switch arranged in series with said at least one member in each of said by-pass branches, said unit is adapted to control a procedure of said switching out by starting from a state in which all first and second switches are closed to control one of said first switches to open when said at least one member associated therewith is in a conducting state for transfer of the current therethrough and said second switch in series with said at least one member last mentioned and/or the first and the second switch associated with the other said at least one member to open when said at least one member first mentioned is in the blocking state and to control a procedure of a switching in by controlling one of said first switches to close, then the second switch in parallel with the other first switch to close when said at least one member in the branch of the second switch last mentioned is in the blocking state and finally the second switch last mentioned to close when said at least one member in parallel therewith is in the conducting state.

According to another embodiment of the invention said unit is adapted to control said procedures of switching in and switching out by utilizing a conducting state and a blocking state of said at least one member in one of said by-pass branches for the switching in procedure and the blocking state and the conducting state of said at least one member in the other of said by-pass branches for the switching out procedure. This means that said at least one member in each said by-pass branch may be dimensioned exactly after the type of procedure in which it is used, which especially enables cost saving.

According to another embodiment of the invention, the device has for forming said switches spaced apart on one hand a fixed first main contact adapted to be connected to one of said feeder and said load and on the other a fixed second main contact adapted to be connected to the other of said feeder and said load, in the gap between said main contacts on one hand a fixed first member contact connected to said first main contact by a first said at least one member and on the other a fixed second member contact connected to said second main contact by a second said at least one member and a movable contact movable between a closing position in which it connects said first main contact to said second main contact and by that the feeder to the load and an opening position, in which a gap is formed between said main contacts, said member contacts are arranged along the extension of said movable contact, so that in said closing position said movable contact makes contact to said member contacts for forming a connection between said first main contact and first member contact and said second main contact and second member contact on one hand through said movable contact and on the other through said at least one member in parallel therewith, and said unit is adapted to control a procedure of a switching out by synchronization of the movement of the movable contact with the current in said feeder for separating said first main contact from said movable contact when said first at least one member is in a conducting state for transferring the current therethrough and upon that separate said first member contact from said movable contact when said first at least one member next time is in the blocking state, and a procedure of a said switching in by synchronization of the movement of the movable contact with the voltage of said feeder, in which the movable contact starts from a position in which it makes contact with the first main contact and first member contact, to make contact with the second member contact when said second at least one member is in the blocking state and to make contact with said second main contact and by that closing the path between the first and second main contact when said second at least one member is the next time in the conducting state.

This construction of the device obtaining two first switches and a second switch located therebetween by the arrangement of such fixed contacts and a movable contact constitutes a simple and reliable way to obtain said synchronization of the switching in and switching out procedures.

According to another embodiment of the invention the device is adapted to switch in and out a load with respect to a three-phase alternating voltage feeder, and the device has one set of said mechanical switches and by-pass branches with said at least one member for each said phase.

According to an embodiment of the invention said three movable contacts are fixedly interconnected for making the movements thereof and by that the switching in and switching out of the three phases dependent upon each other. Such a fixedly interconnection means that a desired sequence of making and opening contacts in the respective phase may simply and reliably be obtained.

According to another embodiment of the invention the relationship of the lengths of said movable contacts and/or the positioning of said fixed contacts of each phase are adjusted to obtain a mechanical offset resulting in a determined time delay between the phases during said operations of switching in and switching out. This means that it will only be required to start the movements of one and by that of all said movable contacts at a determined time and then move them with a determined speed for obtaining exactly a determined time delay (phase shift) between the phases during said operation of switching in and switching out.

According to another embodiment of the invention said unit comprises an electric motor, and the movable contact/contacts is/are connected to the output shaft of said motor, which constitutes a way to exactly control the movement of said movable contact/contacts and by that the switching in and switching out operations of said device.

According to another embodiment of the invention said movable contact/contacts is/are arc-shaped with the centre of said arc coinciding with the shaft of said motor, so that turning of said motor shaft will result in a movement of said movable contact/contacts along a circle.

According to another embodiment of the invention said first diode or plurality of diodes connected in series are directed oppositely to said second diode or plurality of diodes connected in series.

According to an embodiment of the invention said unit is adapted to control a procedure of a said switching out by controlling the movable contact of a first phase to be separated from said first main contact of that phase at a time $T_0$ and the movable contact of a third said phase 240 electrical degrees behind said first phase to be separated from the first main contact of that phase about T/6 after $T_0$ and the movable contact of a second phase 120 electrical degrees behind the first phase to be separated from the first main contact of that phase about T/3 after $T_0$ for transferring the current of the respective phase through the respective said first at least one member of that phase, and said movable contacts to continue the movement for separating said movable contact of the first phase from said first member contact about T/2 after $T_0$ and the movable contacts of the second and third phase to be simultaneously separated from said first member contact of these phases about 3 T/4 after $T_0$ for starting to create a said gap when no current is flowing in the respective phase, T being the period of said alternating voltage. This procedure means that the main contacts are opened and the currents are commutated to said members after the zero crossing of the current in the respective phase, which results in commutations substantially without arcing. Furthermore, the member contacts are opened when said members, such as diodes, have switched into the blocking state and the currents through the phases are zero, which prevent arcing in the contacts. Furthermore, by separating the first main contact of said third phase after that of said first phase and then the first main contact of the second phase the switching out procedure may be shortened.

According to another embodiment of the invention said unit is adapted to control said movable contacts to be separated from the respective first main contact with a delay with respect to a zero crossing of the current in the respective phase for ensuring that said first at least one member is in the conducting state upon separation of said movable contact from the respective first main contact. It is then preferred that said delay is at least T/40 for ensuring that said first at least one member is in the conducting state, but also that it is shorter than T/4, preferably shorter than T/8, so that the current may efficiently be transferred to said at least one member substantially without arcing.

According to another embodiment of the invention said unit is adapted to control said movable contact of the respective phase to be separated from the respective first member contact <T/4, preferably <T/8 after the respective first at least one member has assumed said blocking state. Although it is necessary to ensure that the first at least one member has assumed said blocking state before the movable contact is separated from the first member contact it is desired to keep the delay as short as possible from the cost point of view to keep the necessary voltage blocking capability of said at least one member and by that the number of such members necessary to connect in series at a low level.

According to another embodiment of the invention said unit is adapted to control the movable contacts of each phase in a procedure of a said switching in by making contact to said second member contact for a second and a third phase 120 electrical degrees behind the second phase simultaneously at a time $t_0$ when said second at least one member in these phases is in the blocking state and making contact to said second main contact of these two phases simultaneously about T/2 after $t_0$ when said second at least one member is in the conducting state for transferring the current in the path from the first main contact to the second main contact and the movable contact of a first said phase 120 electrical degrees ahead of said second phase to make contact with the second member contact of that phase about 3 T/4 after $t_0$ and making contact with said second main contact of said first phase about 5 T/4 after $t_0$, T being the period of said alternating voltage. It has turned out that this sequence of switching in the phases reduces transients in the currents to nearly zero. By making contact to said second member contact of the first phase 3 T/4 after the two other phases the switching device will in the case of a load in the form of a capacitor or capacitor bank energize this at the same point where it ended when it interrupted the current, so that the inrush current is minimized when such capacitor or capacitors are already charged.

According to another embodiment of the invention said unit is adapted to control said movable contact of the respective phase to make contact with said second member contact with a delay with respect to a zero-crossing of the voltage in the respective phase for ensuring that said second at least one member is in the blocking state when said contact is made.

According to another embodiment of the invention said delay is at least T/40 and shorter than T/4, preferably shorter than T/8.

According to another embodiment of the invention said unit is adapted to control said movable contact to start to make contact with said second main contact with a delay after said second at least one member has started to conduct for ensuring that these members of the phases are then in the conducting state. It is of course necessary to ensure that said second at least one member is in the conducting state when making contact, but the contact making should be made as short as possible after said conducting state has been assumed for avoiding arcing. Said delay is preferably at least T/40 and shorter than T/4, preferably shorter than T/8.

According to another embodiment of the invention the first and second said at least one member associated with a third phase 240 electrical degrees behind a first phase and 120 electrical degrees behind a second phase are oppositely directed with respect to the corresponding said first and second at least one member in the first and second phase, which makes it possible to speed up the switching in and switching out procedures resulting in less transients in the system.

According to another embodiment of the invention the number of said at least one member adapted to be utilized in the switching in procedure is higher than the number of said at least one member adapted to be utilized in the switching out procedure. This is due to the fact that said members utilized in the switching in procedure have to be able to block the entire voltage of the phase after closing the respective first switch. However, the members utilized in the switching out procedure have only to be able to block a part of that voltage built up before the respective switch is opened, so that by using only members of one by-pass branch for switching out and members of the other by-pass branch for switching in costs may in this way be saved for the members first mentioned. It is of course equivalent to have just as many members first mentioned but with a lower rating.

According to another embodiment of the invention the device has a plurality of said members connected in series in each said by-pass branch, which may be suitable for being able to together block the voltage to be blocked in a blocking state of said members.

According to another embodiment of the invention the device comprises for each by-pass branch a casing enclosing all said at least one members belonging to said branch, which constitutes a suitable way to arrange such members, such as diodes, while protecting them from the environment.

According to another embodiment of the invention each said at least one member is a diode, which constitutes a cost efficient alternative to obtain such a member in the switching device according to the invention.

According to another embodiment of the invention said fixed contacts are designed to partially grip around said movable contact and bearing circumferentially thereupon. This means that low resistance contacts may be obtained between the fixed contacts and the movable contact also during movement thereof.

According to another embodiment of the invention said main contacts are designed to enclose and bear against a substantially greater part of the circumference of a respective movable contact than said member contacts, which do not have to make a contact with said movable contact being just as good as for said main contacts. This means that in the case of an arc-shaped movable contact and when said fixed contacts are arranged substantially externally of said movable contacts with respect to the centre of said arc the gap between a member contact will be increased with respect to the case of designing them as the main contact, so that a higher voltage may be held by the gap therebetween.

According to another embodiment of the invention said fixed contacts are arranged substantially externally of said movable contacts with respect to the centre of said arc.

According to another embodiment of the invention at least one of said fixed contacts is provided with a helical spring arranged to bear upon said movable contact by turns thereof for being utilized as current transmitting elements, which ensures a proper contact making of such a fixed contact to the movable contact while allowing reasonable tolerances.

According to another embodiment of the invention it is adapted to be connected to a load in the form of one or more capacitors, such as a capacitor bank, which is a preferred application of a device according to the invention.

The invention also relates to a use of a device according to the invention for switching in and switching out one or more capacitors with respect to a three-phase alternating voltage feeder for reactive power compensation. It is also possible to use a plurality of devices according to the invention for dividing a large capacitor bank into smaller units and operate each unit with a separate said switching device, so that a stepwisely controllable capacitor bank may be achieved. Since a device according to the invention may be operated frequently the load variations of a three-phase alternating voltage feeder, such as a medium voltage distribution system, may be followed and the capacitor bank may be switched in or our on for instance an hourly basis to minimize power losses and increase maximum power flow in the system.

The invention also relates to a use of a device according to the invention for electricity supply within industry or in distribution or transmission networks as well as a use of such a device for switching in and out a load with respect to a three-phase alternating voltage feeder adapted to have a voltage between 1-52 kV and conducting a current between said feeder and load of 100 A-2 kA.

The invention also relates to a method for switching in and out a load with respect to an alternating voltage feeder according to the appended method claim, and the advantages thereof appear from the above discussion of a switching device according to the invention.

Further advantages and advantageous features of the invention will appear from the following description.

BRIEF DESCRIPTION OF THE DRAWINGS

With reference to the appended drawings, below follows a specific description of preferred embodiments of the invention cited as examples.

In the drawings:

FIG. 1 is a very schematic circuit diagram illustrating a possible use of a switching device according to the invention, FIG. 2 is a perspective view of a switching device according to an embodiment of the invention, FIG. 3 is an enlarged view of the switching device according to FIG. 2 for showing further details, FIG. 4 is an enlarged view illustrating the design of the fixed contacts of a switching device according to an embodiment of the invention, FIGS. 6 and 7 are graphs showing the voltage U between the main contacts for the respective phase and the current I between the feeder and the load for the respective phase versus time, respectively, during an operation of switching out (opening) a said load with respect to a three-phase alternating voltage feeder, FIGS. 9 and 10 are graphs showing the voltage U between the main contacts for the respective phase and the current I between the feeder and the load for the respective phase versus time, respectively, during an operation of switching in (closing) a said load with respect to a three-phase alternating voltage feeder, FIGS. 12 and 13 are graphs showing the voltage U between the main contacts for the respective phase and the current I between the feeder and the load for the respective phase versus time, respectively, during an operation of switching out (opening) a said load with respect to a three-phase alternating voltage feeder, for a load of charged capacitors.

DETAILED DESCRIPTION OF THE INVENTION

FIG. 1 shows schematically a possible use of a switching device according to the present invention. A number of switching devices 1 according to the invention are arranged for switching in and out capacitor bank units 2-5, which may for instance be of 1, 2, 4 and 8 Mvar, with respect to a three-phase alternating voltage feeder 6 in the form of a medium voltage distribution network for reactive power compensation. It is illustrated how the capacitor bank is connected to the feeder 6 through a breaker 7 able to handle short circuit currents. By switching in and out different numbers of said capacitor bank units 2-5 different degrees of reactive power compensation may be obtained for adaption thereof to the conditions prevailing for minimizing power losses in the system.

Figure 5:
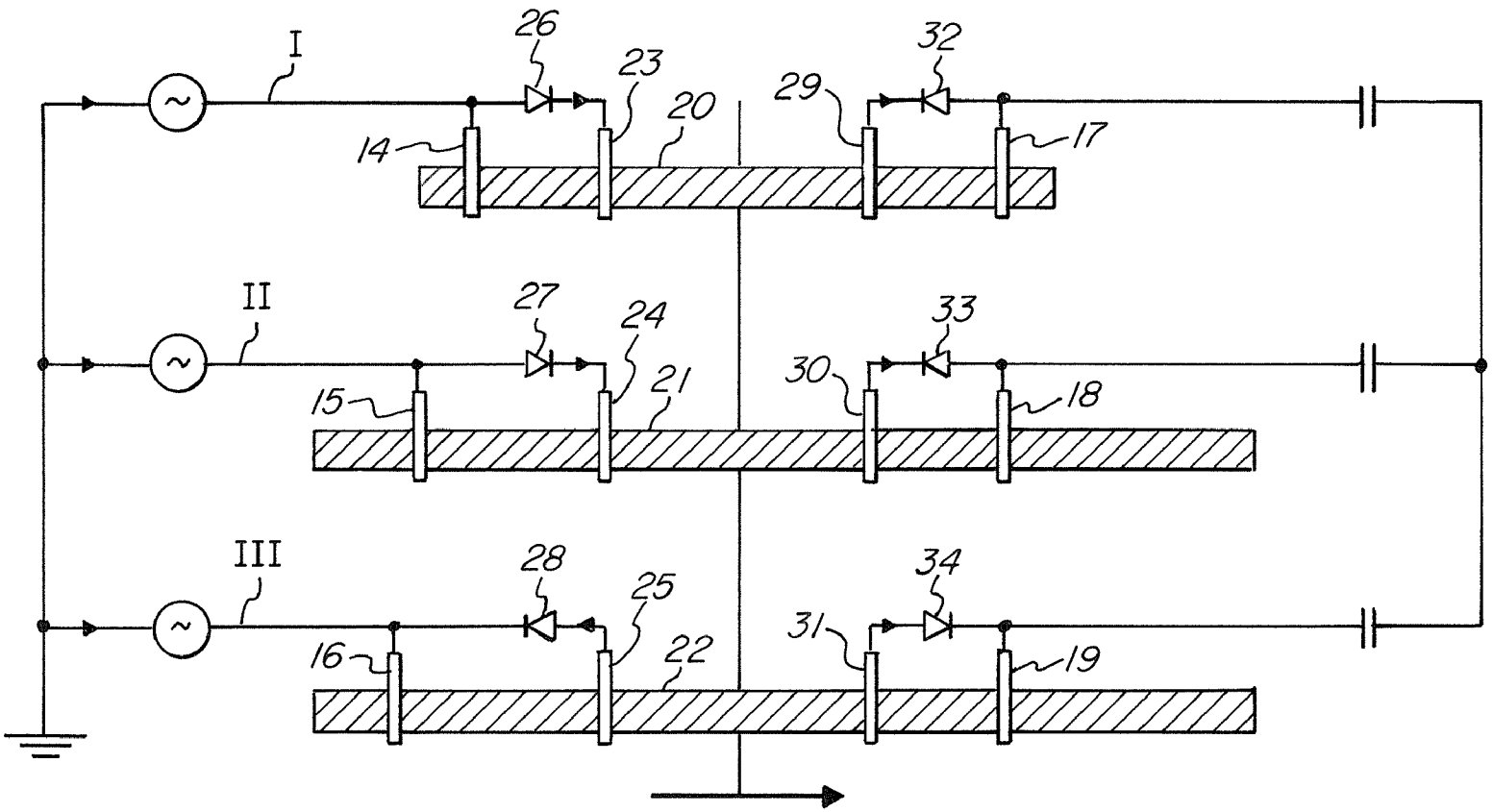
FIG. 5 is a simplified circuit diagram illustrating a switching device according to an embodiment of the invention.

FIG. 2 shows a switching device according to an embodiment of the invention more in detail. Reference is simultaneously made to FIGS. 3-5. The device has means 8-10 in the form of contact plates for connecting a first (I), second (II) and third (III) phase, respectively, of a three-phase alternating voltage feeder thereto as well as means 11-13 for connecting a load, such as a capacitor bank thereto. Each phase has a fixed first main contact 14-16 adapted to be connected to said feeder and a fixed second main contact 15-19 adapted to be connected to said load as well as a movable contact 20-22 movable between a closing position in which it connects said first main contact to said second main contact as shown in FIG. 2, and by that the feeder to the load and an open position, in which a gap is formed between said main contacts.

The device also comprises for each said phase spaced apart in the gap between the main contacts a fixed first member (diode) contact 23-25 connected to said first main contact by a first said member or plurality of members 26-28 connected in series and/or in parallel, such as arranged in a stack, and a fixed second member (diode) contact 29-31 connected to the second main contact by a second said member 32-34 or a plurality of members connected in series and/or in parallel, such as in a stack. Said members are here diodes, and this word will hereinafter be used for member. The diodes connected to the same diode contact are enclosed in a casing 45 therefor.

It is shown how four fixed contacts of each phase are arranged along a circular arc and how each movable contact has a corresponding arc-shape, so that in said closing position the respective movable contact makes contact to said diode contacts for forming a connection between said first main contact and first diode contact and said second main contact and second diode contact on one hand through said movable contact and on the other through said diode or plurality of diodes in parallel therewith.

All three movable contacts 20-22 are rigidly connected to one and the same movable part, namely the output shaft 35 of an electric motor 36 adapted to rotate the shaft 35 for moving the movable contacts 20-22 and by that opening or closing the switching device and by that the connection between said feeder and load. A motor control unit 37 receives information about current and voltage in said feeder from sensors 38 and 39 for the control of the motor 36. The motor control unit 37 also receives signals from a sensor 50 sensing the position of the motor shaft 35 for appropriately controlling the movement of the shaft 35 and by that of the movable contacts while considering information received from the sensors 38, 39 and 50.

By selecting the relationship of the lengths of the movable contacts and the positioning of the different fixed contacts of each phase a mechanical offset resulting in a determined time delay between the phases during operations of switching in and switching out may be obtained. This means that no separate control of each separate phase is needed, but it is only necessary to ensure that the motor starts to turn the shaft 35 at a determined time and then turn it with determined speed for obtaining a desired sequence for the switching in and switching out procedure. These procedures will be described more in detail further below.

It appears clearly from FIGS. 3 and 4 how the fixed contact bears externally upon the movable contact, and they are for that sake designed to partially grip around the movable contact for bearing circumferentially thereupon. A resilient bearing action is obtained by springs 40 received within the respective fixed contact. It is also shown how the main contacts 14, 17 are designed to enclose and bear against a substantially greater part of the circumference of a respective movable contact than the diode contacts 23, 29. More exactly, the main contacts cover more than ¾ of the circumference of the movable contact, whereas the diode contacts cover less than ½ of the circumference of the movable contact. Thus, each movable contact has a "banana shape" with a substantially circular cross-section and is movable along a path defined by the fixed contacts.

The motor is designed to turn only in one direction for obtaining opening and closing of the device, which is indicated by the arrow 41 in FIG. 5. It also appears from FIG. 5 that the first and second diodes associated with the respective phase are directed oppositely to each other, and that the diodes of the third phase are directed oppositely to the corresponding diodes of the other two phases. This is done for enabling a smoother switching in and switching out of the load with respect to the feeder as will be explained below. It is pointed out that each diode symbol in FIG. 5 may stand for a plurality, such as 4 or 8, diodes connected in series.

The procedure of switching out the load with respect to the feeder for the switching device shown in FIGS. 2-5 will now be described while making reference to FIGS. 8*a*-8*i* and FIG. 6 and FIG. 7 showing the development of the voltage between the main contacts and the currents between the load and the feeder in the respective phase over time, in which the solid lines relate to the first phase I, the dashed longer lines to the second phase II and the dashed shorter lines to the third phase III. The experiments were carried out with a switching device operating a 2.9 Mvar capacitor bank at 11 kV giving a capacitive current of 150 A.

The procedure is started when the sensor 38 senses a zero crossing of the current in the first phase I, which is indicated by 0. The movable contacts then have the position shown in FIG. 8*a*. The motor 36 starts to rotate the shaft clockwise as seen in the direction from the motor towards the movable contacts at a point of time one period T, which in the case of a frequency of 50 Hz in the three-phase alternating voltage means 20 ms, after the time 0 for at a time $T_0$ reaching the position according to FIG. 8*b* of the movable contacts, in which the movable contact of the first phase separates from the first main contact of that phase. The first diode of this phase has then entered into a conducting state, so that the current I through this phase will now be transferred to the diode substantially without arcing when moving further to the position according to FIG. 8*c*. The movable contact of the third phase will in this position about T/6 after $T_0$ ($=T_1$) be separated from the first main contact of that phase, so that when moving further to the position according to FIG. 8*d* the current in this phase III will be transferred to the first diode of that phase being in the conducting state. The position according to FIG. 8*e* is reached at a time $T_2$, which is about T/3 after $T_0$, and when moving further from this position the movable contact of the second phase will be separated from the first main contact of that phase for transferring the current through the first diode thereof.

Figure 8C:
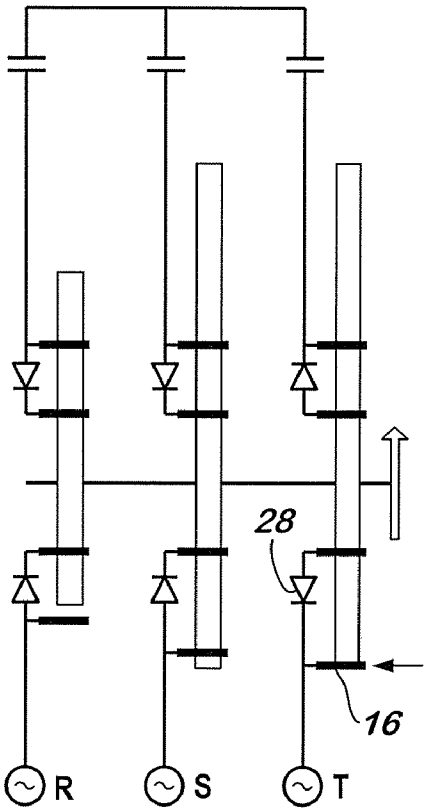
FIGS. 8*a*-8*i* shows subsequent steps of a switching out procedure according to the invention.
Figure 8B:
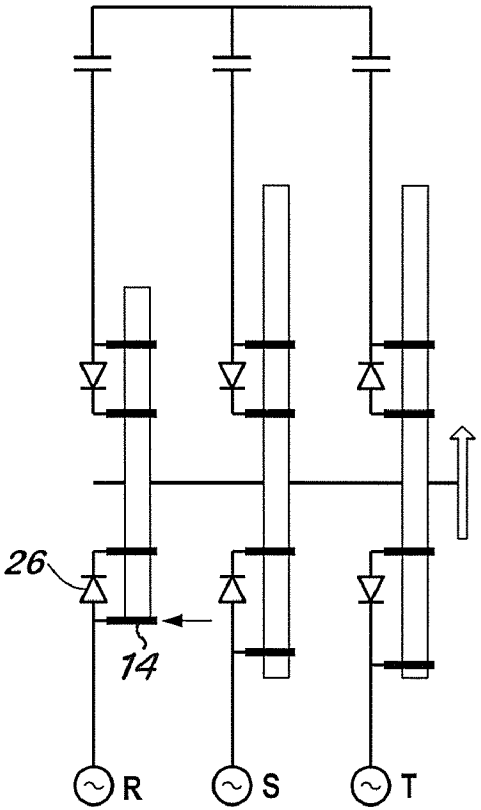
Figure 8A:
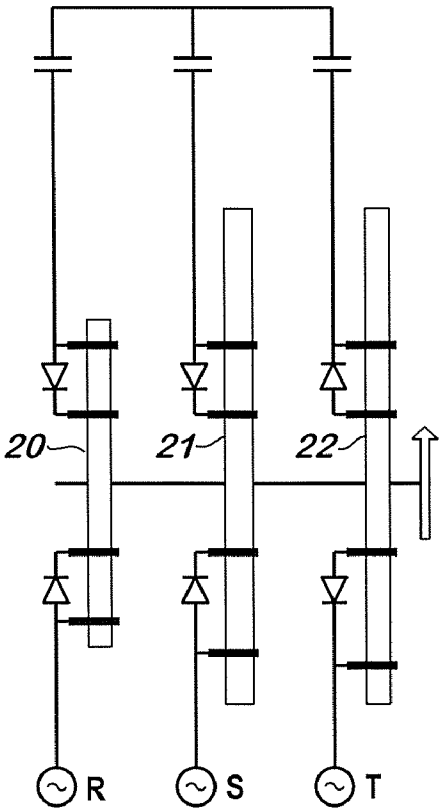
Figure 8F:
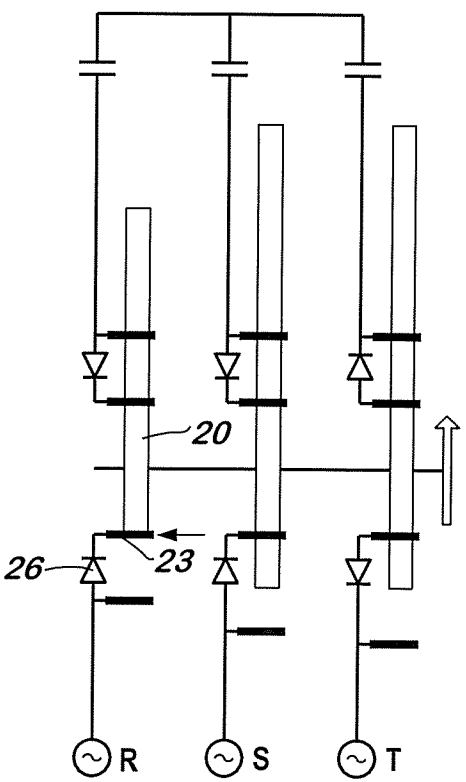
Figure 8E:
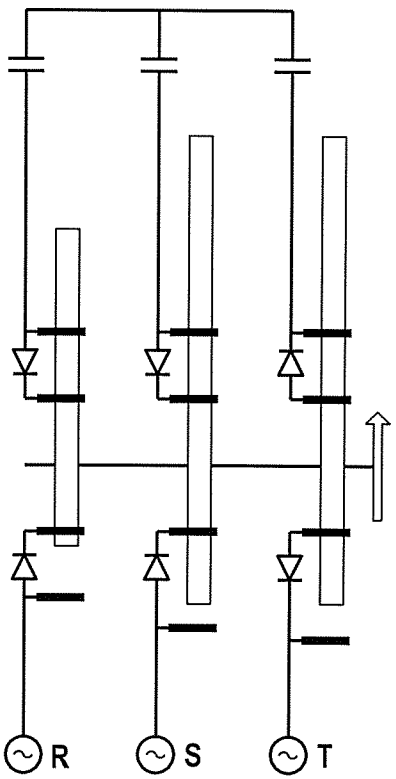
Figure 8D:
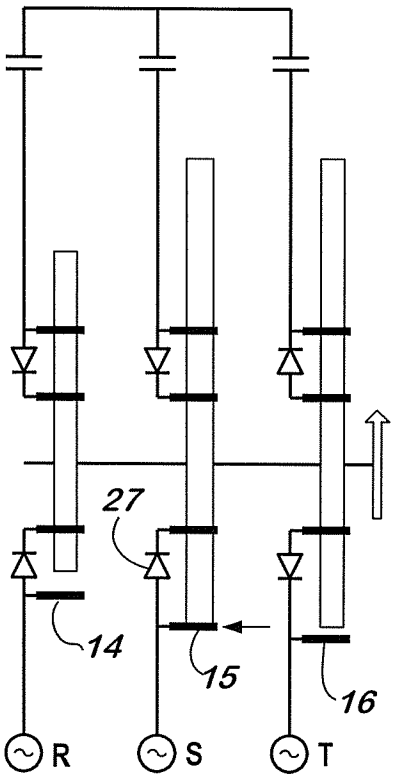
Figure 8I:
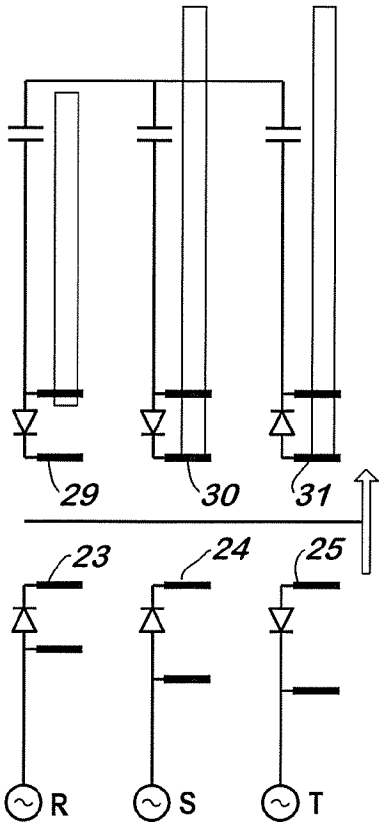
Figure 8H:
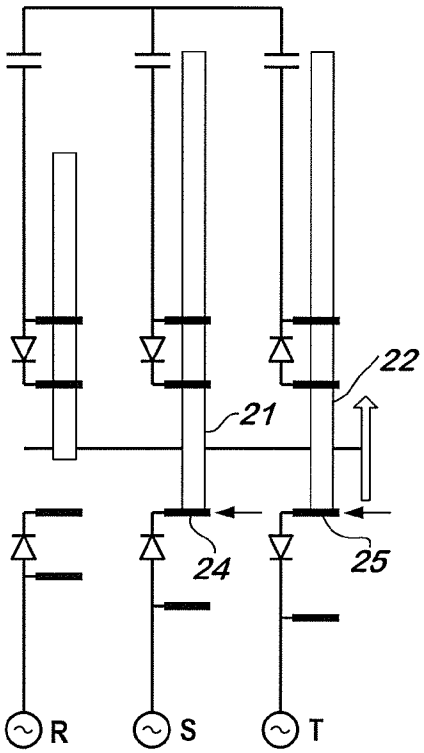
Figure 8G:
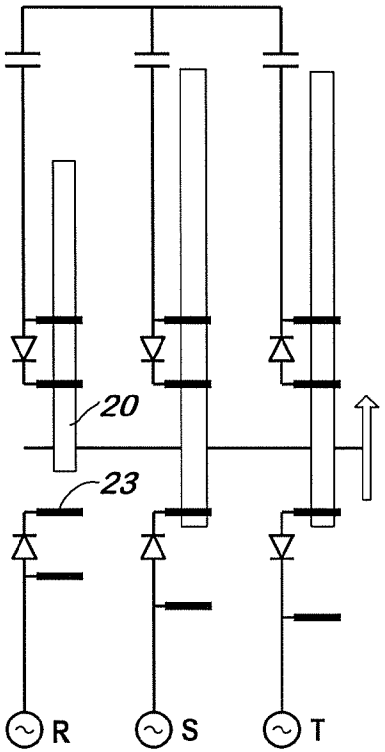
Figure 11C:
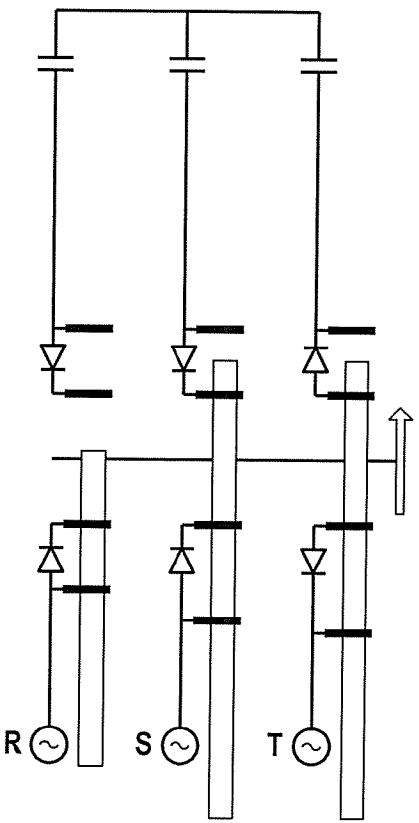
FIGS. 11*a*-11*h* shows subsequent steps of a switching in procedure according to the invention.
Figure 11B:
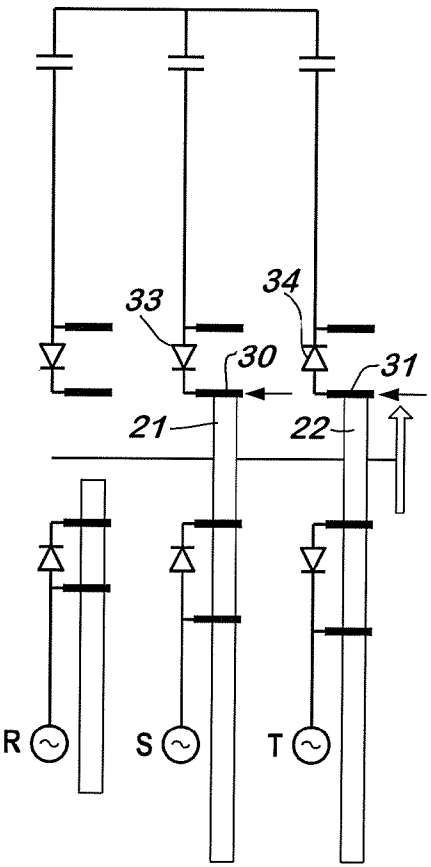
Figure 11A:
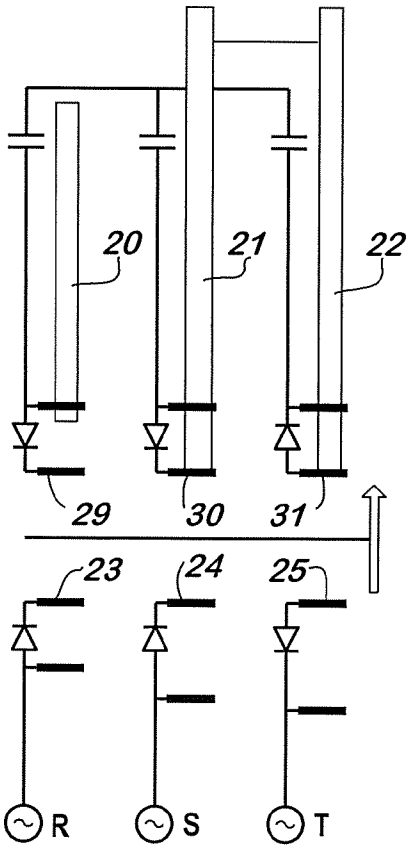
Figure 11F:
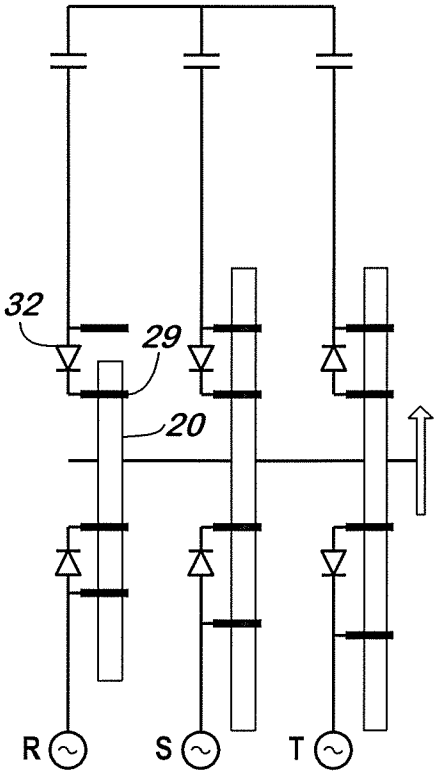
Figure 11E:
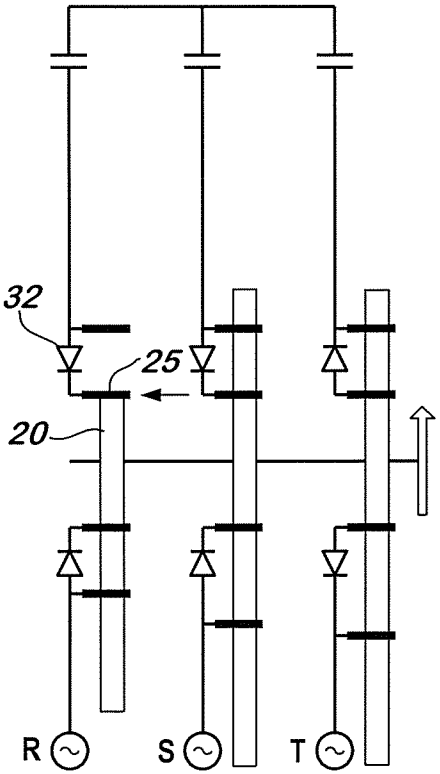
Figure 11D:
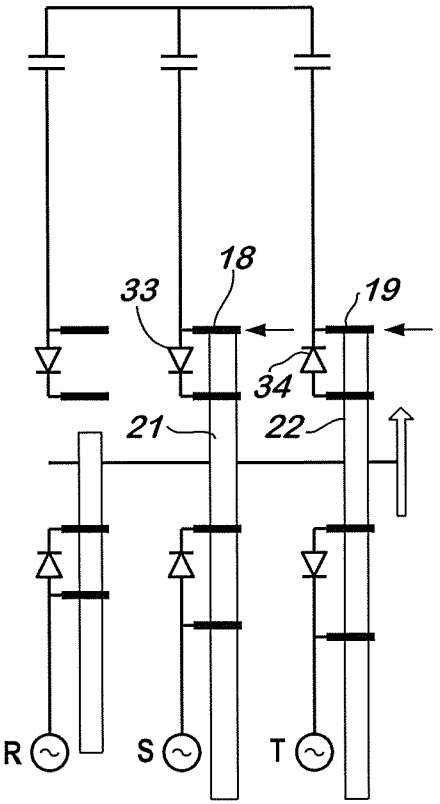
Figure 11H:
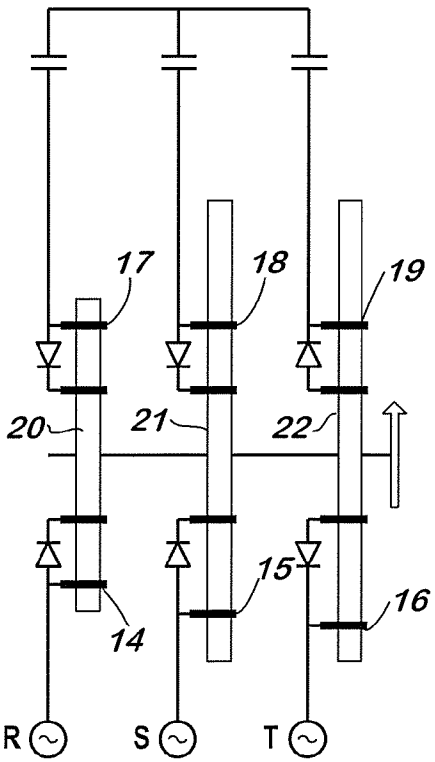
Figure 11G:
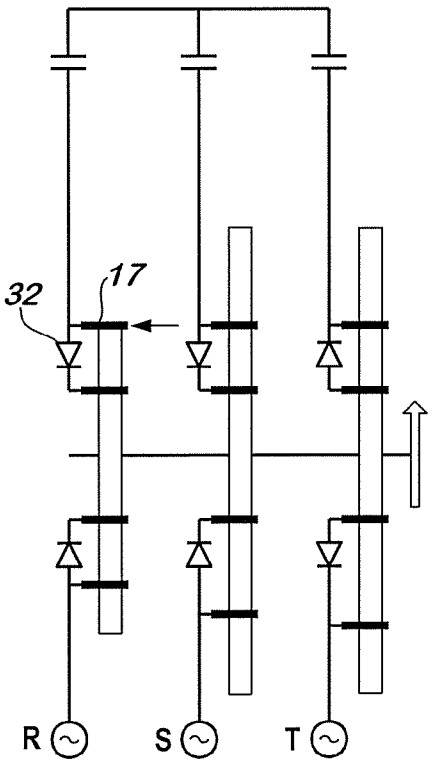

The movement of the movable contacts is then continued, and in a position according to FIG. 8*e* the first diode of the first phase will enter the blocking state, so that when reaching the position according to FIG. 8*f* at a time $T_3$, about T/2 after $T_0$, the movable contact 20 of that phase will be separated from the first diode contact of that phase without any arcing and while starting to creating a gap that can withstand the recovery voltage between the movable contact and said diode contact (see position according to FIG. 8*g*), in which the first diodes in the second and third phase enter ($T_4$) the blocking state. When moving further to the position according to FIG. 8*h* the movable contacts of the second and the third phase will at a time $T_5$ about 3 T/4 after $T_0$ simultaneously be separated from the respective first diode contact for starting to create a said gap also for these cases. Finally, the position in FIG. 8*i* is reached, where the voltage in the respective phase is taken by the gap between the first and second diode contacts thereof. As seen in the Figures this switching out procedure does not result in any harmful transients.

A procedure or closing will now be described with reference to FIGS. 11*a*-11*h* and FIGS. 9 and 10, which correspond to FIGS. 6 and 7. The closing procedure is started from the open position shown in FIG. 11*a* by starting to rotate the motor shaft and by that move the movable contacts according to the arrow 41 one period after a zero crossing of the voltage in the first phase has been sensed. At a point of time $T_0$ shown in FIG. 11*b*, in which the second diodes of the second and third phase are in a blocking state the movable contacts of these phases will enter into contact with the second diode contacts of these phases. The movable contacts of the second and third phase will then move further through the position according to FIG. 11*c* and then reaching the position in FIG. 11*d* at a time $t_1$ about T/2 after $t_0$ at which the second diode of these phases have entered the conducting state, so that the currents flowing through the diodes will be transferred to flow to the main contact of these phases. When moving further to the position according to FIG. 11*e* the movable contact of the first phase will make contact with the second diode contact of that phase at a time $t_2$ about 3 T/4 after $t_0$ when the second diode thereof is in the blocking state and then when reaching the position according to FIG. 11*e* this diode has assumed the conducting state and conducts a current, which will then be transferred to the second main contact of this phase at a point of time $t_3$ about 5 T/4 after $t_0$. Thus, the diode contacts have been closed when the diodes were in a blocking state and the currents switched on at zero crossing of the voltage over the respective diode for smoothly building up the current through the respective phase.

FIGS. 12 and 13 correspond to FIGS. 9 and 10 and show the voltage and current for the three phases when carrying out the switching in procedure shown in FIGS. 11*a*-11*h* for the case of switching in a load in the form of charged capacitors. It appears that no noticeable inrush current may be discovered, and this is achieved by closing the second and third phase when the phase to phase voltage thereacross is zero and then the last, first phase 3 T/4 after that, so that the switching device will energize the capacitor bank at the same point where it ended when it interrupted the current and by that the inrush current will be minimized. Thus, excellent performance is obtained by synchronized closing on an already charged capacitor without any voltage measurement on the capacitor side.

FIGS. 14-17 show very schematically different ways of realizing a switching device according to the present invention. In these Figures the main configuration of a device is shown for only one phase. When the alternating voltage of said feeder has more than one phase the switching device will have a corresponding structure for the other phases.

Figure 14:
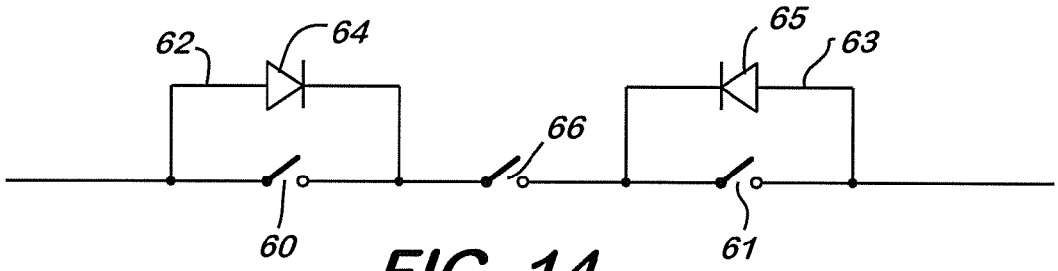
FIGS. 14-17 are simplified circuit diagrams showing different possible embodiments of a device according to the present invention.

FIG. 14 shows a switching device having two first switches 60, 61 adapted to be connected in series in a current path between an alternating voltage feeder and a load and each having a by-pass branch 62, 63 with at least one member 64, 65 with ability to block current therethrough in at least a blocking direction and conduct current therethrough in at least one direction, each here symbolized by a diode. The device also has a second switch 66 connected in series with said diodes 64, 65 and arranged as middle switch between the first switches 60, 61. This configuration corresponds to that of the embodiment shown in FIGS. 2-5, in which the first switches are formed by on one hand the first main contact 14 and the diode contact 23 in co-operation with the movable contact 20 and on the other the second main contact 17 and the diode contact 29 in co-operation with the movable contact 20. The second switch is formed by the two diode contacts 23 and 29 in co-operation with the movable contact 20.

Figure 15:
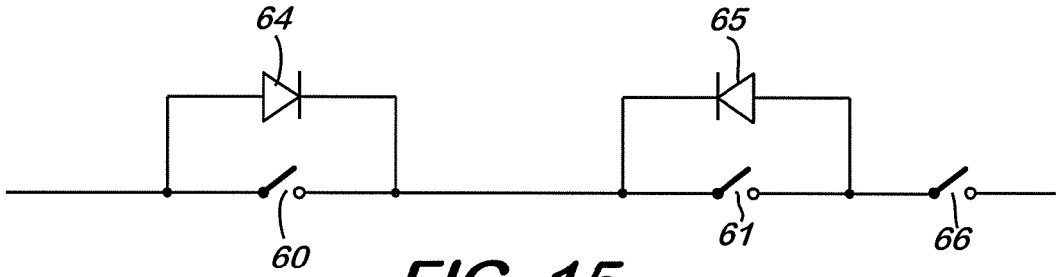

FIG. 15 shows an alternative configuration to that according to FIG. 14 differing therefrom by an arrangement of the second switch 66 at one end of the series connection thereof and said first switches 60, 61. The control of a switching in and a switching out procedure of a switching device with a configuration according to FIG. 15 will be similar to that of the configuration according to FIG. 14.

Figure 16:
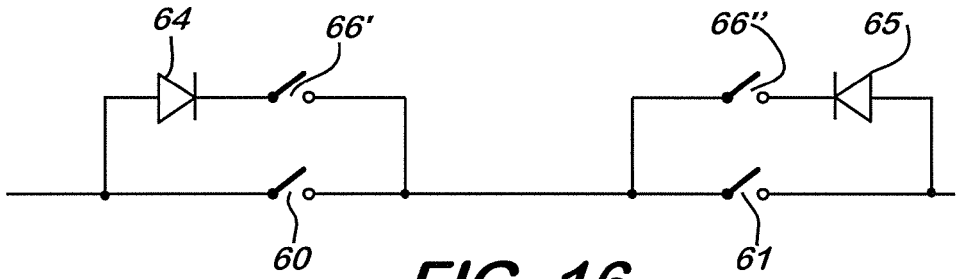

FIG. 16 shows a further alternative configuration, which has two second switches, in which one second switch 66', 66" is arranged in series with said member 64, 65 in each of the by-pass branches. For this configuration a procedure of switching out may be started from a state in which all first and second switches are closed by controlling one of the first switches to open when the member associated therewith is in a conducting state for transfer of the current therethrough and the second switch in series with said member last mentioned and/or the first and the second switch associated with the other said member to open when the member first mentioned is in the blocking state. This means that when using the diode 64 for this switching out procedure the completion thereof may be obtained by either opening the second switch 66' or opening the first switch 61 and the second switch 66" or all these switches. A procedure of a switching in may be achieved by controlling one of the first switches to close, then the second switch in parallel with the other first switch to close when the member in the branch of the second switch last mentioned is in the blocking state and finally the second switch last mentioned to close when said member in parallel therewith is in the conducting state.

Figure 17:
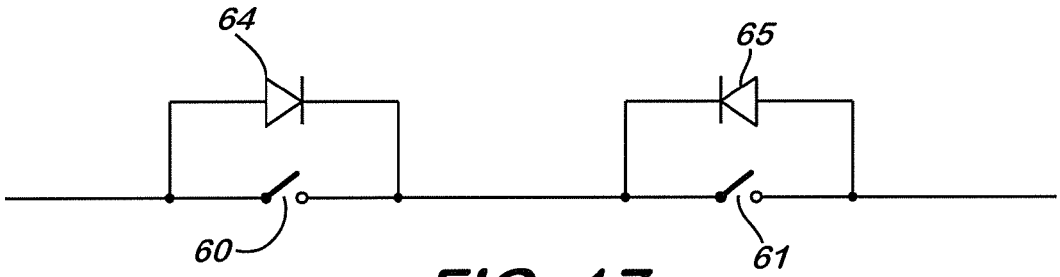

Finally, FIG. 17 shows a further possible configuration of a switching device according to the invention. This configuration differs from that according to FIGS. 14 and 15 by the fact that it has no second switch, which also means that the members 64, 65 have to be able to withstand a possible voltage over the device in the switched out state. The switching out procedure may be carried out by starting to open the first switch 60 when the member 64 is in the conducting state for transferring the current thereto without any substantial arcing. When the member 64 then assumes the blocking state the first switch 61 is opened without any arcing. A switching in procedure is carried out by closing the first switch 60 when the member 65 is in the blocking state without any arcing and then closing the first switch 61 when the member 65 is conducting current for transferring the current through the first switch 61 without any substantial arcing and completing the switching in procedure.

The invention is of course not in any way restricted to the embodiments thereof described above, but many possibilities to modifications thereof will be apparent to a person with ordinary skill in the art without departing from the basic idea of the invention as defined in the appended claims.

A switching device according to the invention may, as already stated, be used to switching in and out other types of load than capacitors with respect to an alternating voltage feeder. Furthermore, the feeder may be of another type than an electric power network, such as a generator.

Although preferred, the movable contacts do not have to be moved along a circular path, but other paths, such as linear, are conceivable.

The switching device may also be used to operate capacitor banks back-to-back, and field tests have shown that the switching device according to the invention then gives very low inrush currents. Thus, it will be possible to eliminate inrush limiting reactors in these applications.

It is shown in the Figures that for each phase said at least one member of one by-pass branch has with respect to said current path the opposite blocking direction to that of said at least one member of the other by-pass branch, but the invention also covers the case of having said members arranged with the same blocking direction. However, they should have the opposite blocking direction when charged capacitors constitute the load to be switched in to the alternating voltage feeder. This is due to the preferred feature described above to close the last phase of a three-phase alternating voltage feeder 3 T/4 after the other two.

The term "by-pass branch" used in this disclosure is to be interpreted as a branch connected in parallel with the respective switch, so that said at least one member in question is connected in parallel with the respective switch.

It is pointed out that said "another mechanical switch of the device" mentioned in the claims does not have to be located close to said first switches, although it may in fact even be one of the first switches, but it may be arranged at a considerable distance to said first switches and be for instance a separate disconnector.

It is also within the scope of the present invention to change side of the connection of the load and the feeder to the switching device, so that the load would in FIG. 2 be connected to the plates 8-10 and the feeder to the plates 11-13. An advantage of that configuration is that the movable contacts 20-22 may in the switched out state be moved closer to the switched in state while still ensuring galvanic disconnection of the feeder, i.e. close to the position shown in FIG. 11*b*, so that switching in may from this "ready position" take place faster. However, in such an embodiment galvanic separation of the feeder will not result as soon as the movable contacts 20-22 leave the corresponding fixed contacts as is the case in the embodiment described above, but the movable contacts have for this sake to move further than shown in FIG. 8*i*.

What is claimed is:

1. A device for switching in and out a load with respect to an alternating voltage feeder, said device having at least one mechanical switch in a current path adapted to connect the feeder and the load, as well as a unit adapted to control said switch to close and open for performing said switching in and out, respectively, characterized in that the device comprises a first and a second mechanical switch each adapted to be connected in series in said current path and each having a by-pass branch with at least one member with ability to block current therethrough in at least a blocking direction and conduct current therethrough in at least one direction, a third mechanical switch arranged as a middle switch between and in series with said first and second mechanical switches and with each said at least one member, and that said unit is adapted to control a procedure of a switching out in synchronization with the current in said current path by opening said first mechanical switch when a first said at least one member in parallel therewith is in the conducting state for transferring the current therethrough and opening another mechanical switch of the device in series with said first at least one member when this first member is in the blocking state and to control a procedure of a switching in in synchronization with the voltage in said feeder by, when a second said at least one member in parallel with said second mechanical switch is in the blocking state, closing said third mechanical switch of the device and closing said second mechanical switch when said second at least one member in parallel therewith is in the conducting state;

wherein said unit is adapted to control a procedure of said switching out by starting from a state in which the first, second, and third mechanical switches are closed and to control said first mechanical switch to open when said first at least one member in parallel therewith is in a conducting state for transfer of the current therethrough and to control said third mechanical switch to open when said first at least one member is in the blocking state; and to control a procedure of a switching in by controlling said first mechanical switch to close, then said third mechanical switch to close when said second at least one member associated with the second mechanical switch is in the blocking state and finally said second mechanical switch to close when said second at least one member in parallel therewith is in the conducting state.

2. The device according to claim 1, characterized in that said unit is adapted to control said procedures of switching in and switching out by utilizing a conducting state and a blocking state of said at least one member in one of said by-pass branches for the switching in procedure and the blocking state and the conducting state of said at least one member in the other of said by-pass branches for the switching out procedure.

3. The device according to claim 1, characterized in that said device has for forming said mechanical switches spaced apart on one hand a fixed first main contact adapted to be connected to one of said feeder and said load and on the other hand a fixed second main contact adapted to be connected to the other of said feeder and said load, in the gap between said main contacts on one hand a fixed first member contact connected to said first main contact by the first said at least one member and on the other a fixed second member contact connected to said second main contact by the second said at least one member and a movable contact movable between a closing position in which said movable contact connects said first main contact to said second main contact and by that the feeder to the load and an opening position, in which a gap is formed between said main contacts, that said member contacts are arranged along the extension of said movable contact, so that in said closing position said movable contact makes contact to said member contacts for forming a connection between said first main contact and first member contact and said second main contact and second member contact on one hand through said movable contact and on the other hand through said first and second at least one members in parallel therewith, and that said unit is adapted to control a procedure of a switching out by synchronization of the movement of the movable contact with the current in said feeder for separating said first main contact from said movable contact when said first at least one member is in a conducting state for transferring the current therethrough and upon that separate said first member contact from said movable contact when said first at least one member next time is in the blocking state, and a procedure of a said switching in by synchronization of the movement of the movable contact with the voltage of said feeder, in which the movable contact starts from a position in which said movable contact makes contact with the first main contact and first member contact, to make contact with the second member contact when said second at least one member is in the blocking state and to make contact with said second main contact and by that closing the path between the first and second main contact when said second at least one member is the next time in the conducting state.

4. The device according to claim 3, characterized in that said device is adapted to switch in and out a load with respect to a three-phase alternating voltage feeder, and that the device has a movable contact, one set of said mechanical switches and by-pass branches with said at least one member for each said phase.

5. The device according to claim 4, characterized in that said three movable contacts are fixedly interconnected for making the movements thereof and by that the switching in and switching out of the three phases dependent upon each other.

6. The device according to claim 5, characterized in that at least one of the relationship of the lengths of said movable contacts and the positioning of said fixed contacts of each phase are adjusted to obtain a mechanical offset resulting in a determined time delay between the phases during said operations of switching in and switching out.

7. The device according to claim 4, characterized in that said unit comprises an electric motor, and that said movable contacts are connected to the output shaft of said motor.

8. The device according to claim 7, characterized in that said movable contacts are arc-shaped with the centre of said arc coinciding with the shaft of said motor.

9. The device according to claim 4, characterized in that said unit is adapted to control a procedure of a said switching out by controlling the movable contact of a first phase to be separated from said first main contact of that phase at a time $T_0$ and the movable contact of a third said phase 240 electrical degrees behind said first phase to be separated from the first main contact of that phase about T/6 after $T_0$ and the movable contact of a second phase 120 electrical degrees behind the first phase to be separated from the first main contact of that phase about T/3 after $T_0$ for transferring the current of the respective phase through the respective said first at least one member of that phase, and said movable contacts to continue the movement for separating said movable contact of the first phase from said first member contact about T/2 after $T_0$ and the movable contacts of the second and third phase to be simultaneously separated from said first diode member of these phases about 3 T/4 after $T_0$ for starting to create a said gap when no current is flowing in the respective phase, T being the period of said alternating voltage.

10. The device according to claim 9, characterized in that said unit is adapted to control said movable contacts to be separated from the respective first main contact with a delay with respect to a zero crossing of the current in the respective phase for ensuring that said first at least one member is in the conducting state upon separation of said movable contact from the respective first main contact.

11. The device according to claim 10, characterized in that said delay is at least T/40 and shorter than T/4.

12. The device according to claim 9, characterized in that said unit is adapted to control said movable contact of the respective phase to be separated from the respective first member contact <T/4 after the respective first at least one member has assumed said blocking state.

13. The device according to claim 4, characterized in that said unit is adapted to control the movable contacts of each phase in a procedure of a said switching in by making contact to said second member contact for a second and a third phase 120 electrical degrees behind the second phase simultaneously at a time $t_0$ when said second at least one member in these phases is in the blocking state and making contact to said second main contact of these two phases simultaneously about T/2 after $t_0$ when said second at least one member is in the conducting state for transferring the current in the path from the first main contact to the second main contact and the movable contact of a first said phase 120 electrical degrees ahead of said second phase to make contact with the second member contact of that phase about 3 T/4 after $t_0$ and making contact with said second main contact of said first phase about 5 T/4 after $t_0$, T being the period of said alternating voltage.

14. The device according to claim 13, characterized in that said unit is adapted to control said movable contact of the respective phase to make contact with said second member contact with a delay with respect to a zero-crossing of the voltage in the respective phase for ensuring that said second at least one member is in the blocking state when said contact is made.

15. The device according to claim 14, characterized in that said delay is at least T/40 and shorter than T/4.

16. The device according to claim 13, characterized in that said unit is adapted to control said movable contacts to start to make contact with said second main contact with a delay after said second at least one member has started to conduct for ensuring that these members of the phases are then in the conducting state.

17. The device according to claim 16, characterized in that said delay is at least T/40 and shorter than T/4.

18. The device according to claim 1, characterized in that the first and second said at least one member associated with a third phase that is 240 electrical degrees behind a first phase and 120 electrical degrees behind a second phase are oppositely directed with respect to corresponding first and second at least one members in the first and second phase.

19. The device according to claim 2, characterized in that the number of said at least one member adapted to be utilized in a switching in procedure is higher than the number of said at least one member adapted to be utilized in a switching out procedure.

20. The device according to claim 1, characterized in that a plurality of said members is connected in series in each said by-pass branch.

21. The device according to claim 1, characterized in that said device comprises for each said by-pass branch a casing enclosing all said at least one members belonging to said branch.

22. The device according to claim 1, characterized in that each said at least one member is a diode.

23. The device according to claim 3, characterized in that said fixed contacts are designed to partially grip around said movable contact and bearing circumferentially thereupon.

24. The device according to claim 23, characterized in that said main contacts are designed to enclose and bear against a substantially greater part of the circumference of a respective movable contact than said member contacts.

25. The device according to claim 8, characterized in that said fixed contacts are arranged substantially externally of said movable contacts with respect to the centre of said arc.

26. The device according to claim 23, characterized in that at least one of the fixed contacts is provided with helical springs arranged to bear upon said movable contact by turns thereof for being utilized as current transmitting elements.

27. The device according to claim 1, characterized in that said device is adapted to be connected to a load in the form of one or more capacitors.

28. The device according to claim 1, characterized in that said at least one member of one by-pass branch has with respect to said current path the opposite blocking direction to that of said at least one member of the other by-pass branch connected in series with the by-pass branch first mentioned.

29. A device for switching in and out a load with respect to an alternating voltage feeder, said device having at least one mechanical switch in a current path adapted to connect the feeder and the load, as well as a unit adapted to control said switch to close and open for performing said switching in and out, respectively, characterized in that the device comprises a first and a second mechanical switch each adapted to be connected in series in said current path and each having a by-pass branch with at least one member with ability to block current therethrough in at least a blocking direction and conduct current therethrough in at least one direction, a third and a fourth mechanical switch, where said third and fourth mechanical switches are each arranged in series with said at least one member in each of said bypass branches, and that said unit is adapted to control a procedure of a switching out in synchronization with the current in said current path by opening said first mechanical switch when a first said at least one member in parallel therewith is in the conducting state for transferring the current therethrough and opening another mechanical switch of the device in series with said first at least one member when this first member is in the blocking state and to control a procedure of a switching in in synchronization with the voltage in said feeder by, when a second said at least one member in parallel with said second mechanical switch is in the blocking state, closing said first mechanical switch of the device and closing said first mechanical switch when said at least one member in parallel therewith is in the conducting state;

wherein said unit is adapted to control a procedure of said switching out by starting from a state in which the first, second, third, and fourth mechanical switches are closed and to control said first mechanical switch to open when said first at least one member associated therewith is in a conducting state for transfer of the current therethrough and said third mechanical switch in series with said first at least one member and the second and fourth mechanical switches associated with the second at least one member to open when said first at least one member is in the blocking state and to control a procedure of a switching in by controlling said first mechanical switch to close, then the fourth mechanical switch in parallel with the second mechanical switch to close when said second at least one member is in the blocking state and the third mechanical switch to close when said at least one member in parallel therewith is in the conducting state.

30. A method for switching in and out a load with respect to a three-phase alternating voltage feeder, in which at least one mechanical switch is arranged in a current path adapted to connect the feeder and the load, characterized in that said method is carried out for a switching device comprising a first and a second mechanical switch each connected in series in said current path and each having a by-pass branch with at least one member with ability to block current therethrough in at least a blocking direction and conduct current therethrough in a least one direction, one set of said mechanical switches and by-pass branches with said at least one member for each said phase, wherein the steps for switching out in synchronization with the current in said current path comprise opening said first mechanical switch when a first said at least one member in parallel therewith is in the conducting state for transferring the current therethrough and opening another mechanical switch of the device in series with said first at least one member last mentioned when this member is in the blocking state; and wherein the steps for switching in in synchronization with the voltage in said feeder comprise, when a second said at least one member in parallel with said second mechanical switch is in the blocking state, closing said first mechanical switch of the device and closing said second mechanical switch when said second at least one member in parallel therewith is in the conducting state;

wherein said method is carried out for a switching device having for each said phase on one hand a fixed first main contact adapted to be connected to one of said feeder and said load and on the other hand a fixed second main contact adapted to be connected to the other of said feeder and said load, in the gap between said main contacts on one hand a fixed first member contact connected to said first main contact by the first said at least one member and on the other hand a fixed second member contact connected to said second main contact by the second said at least one member and a movable contact movable between a closing position in which said movable contact connects said first main contact to said second main contact and by that the feeder to the load and an opening position, in which a gap is formed between said main contacts, said member contacts being arranged along the extension of said movable contact, so that in said closing position said movable contact makes contact to said member contacts for forming a connection between said first main contact and first member contact and said second main contact and second member contact on one hand through said movable contact and on the other hand through said first and second at least one members in parallel therewith, wherein the steps for switching out are performed by synchronization of the movement of the movable contact of each phase with the current in the respective phase of said feeder for separating said first main contact from said movable contact when said first at least one member is in a conducting state for transferring the current therethrough and upon that separate said first member contact from said movable contact when said first at least one member next time is in the blocking state, and that the steps for switching in are performed by synchronization of the movement of the movable contact for each phase with the voltage of the respective phase of said feeder, in which the movable contact starts from a position in which it makes contact with the first main contact and first member contact, to make contact with the second member contact when said second at least one member is in the blocking state and to make contact with said second main contact and by that close the path between the first and second main contact when said second at least one member is the next time in the conducting state.

* * * * *